US005758464A

United States Patent [19]

Hatton

[11] Patent Number: 5,758,464

[45] Date of Patent: Jun. 2, 1998

[54] INSULATION SYSTEM FOR METAL FURRED WALLS

[75] Inventor: Howard Lynn Hatton, Jamestown, Pa.

[73] Assignee: Celotex Corporation, Tampa, Fla.

[21] Appl. No.: 791,310

[22] Filed: Jan. 30, 1997

[51] Int. Cl.[6] ..... E04B 1/74

[52] U.S. Cl. ..... 52/404.1; 52/404.2; 52/404.4; 52/475.1; 52/506.03; 52/510; 52/586.1; 52/763

[58] Field of Search ..... 52/404.1, 404.2, 52/404.4, 763, 475.1, 378, 506.03, 506.04, 510, 586.1

[56] References Cited

U.S. PATENT DOCUMENTS

| | | | |
|---|---|---|---|
| 2,047,154 | 7/1936 | Pimsner . | |
| 2,061,822 | 11/1936 | Bankert | 52/506.04 X |
| 3,466,825 | 9/1969 | Guddal | 52/378 |
| 4,065,902 | 1/1978 | Lindal . | |
| 4,107,891 | 8/1978 | Cotton, Jr. et al. . | |
| 4,593,511 | 6/1986 | Hakasaari | 52/404.4 |
| 4,724,651 | 2/1988 | Fligg . | |
| 5,363,620 | 11/1994 | Liu | 52/586.1 X |
| 5,535,560 | 7/1996 | Fligg . | |
| 5,561,959 | 10/1996 | Alderman et al. . | |

FOREIGN PATENT DOCUMENTS

| | | |
|---|---|---|
| 3202996 | 8/1983 | Germany . |

*Primary Examiner*—Christopher Kent
*Attorney, Agent, or Firm*—Charles W. Vanecek

[57] ABSTRACT

A plurality of insulating panels for installation between and insulation of the metal furrings of a wall system. Preferred panels have a plastic foam core. The vertical side edges of the panels are provided with kerfs for enclosure of the metal furrings and reduction of the thermal bridging conventionally caused by the furrings.

9 Claims, 4 Drawing Sheets

INSULATION SYSTEM FOR METAL FURRED WALLS

BACKGROUND OF THE INVENTION

1. Field of the Invention

This invention relates to an insulated exterior wall framing system, and more particularly to such a system incorporating metal furrings.

2. Description of the Prior Art

With the rapidly increasing cost of energy used in heating and cooling, a multitude of ways of insulating building walls have been devised. Commonly, these methods involve for metal furred wall constructions the filling of the cavities between the furring strips of the wall with insulating material such as batts of fiberglass, blown cellulose, rock wool or foam, or panels of rigid foam. However, in the typical wall assemblies, no matter how much or what type of insulation is installed between the metal furring strips, there is still the underinsulated area of these strips themselves to consider. This area is particularly susceptible to insulation loss because of the high thermal conductivity of the strips.

This framing area, known as the framing factor, comprises a significant underinsulated area of the total opaque exterior wall area depending on construction. In effect, the metal furring strips work against the insulating material by providing a so-called "thermal bridge" between the interior and exterior sides of the wall. The term "thermal bridge" generally designates the zone of a wall that transfers much more heat than surrounding areas. For example, in a common steel stud wall insulated with glass fiber and having an exterior ceramic tile finish, the studs create thermal bridges, with close to 1000 times more heat flowing through a piece of the steel than through a piece of the glass fiber of the same area and thickness. Even though the steel studs (channels) can be made of very thin metal sheet, they still have a significantly detrimental effect on the wall's R-value.

The thermal short circuits at the metal furring channels also offer the potential for condensation which will cause rusting of both them and their involved fasteners. Further damage can result from the moisture's accumulation on the interior drywall coverings. Combination of this moisture and accumulated dirt will produce unsightly shadow streaks at the furring attachments. It would be highly desirable if a way could be found to combat these deficiencies of conventional insulation systems having metal furring mechanically fastened to the wall structures.

OBJECTS OF THE INVENTION

It is therefore an object of the invention to improve the insulating efficiency and overall performance of a wall system which incorporates metal furring strips.

It is another object of the invention to provide insulating panels which are adapted to fit between metal Z-furrings of a wall system and lessen heat transfer by envelopment of the furrings.

It is yet another object of the invention to furnish a metal furred wall system with a plurality of rigid, self-supporting foam boards to form a continuous insulating envelope for the system and significantly reduce the thermal bridging and unsightly interior streaking caused by the furring strips.

SUMMARY OF THE INVENTION

The foregoing and other objects of the invention have been achieved by an insulating board construction which is adapted for installation between and insulation of the metal furrings of a wall system. The construction significantly reduces the amount of energy transferred at the sites of the furring strips. The insulation board is a sheathing panel having at least one side edge which is grooved for partially enclosing a metal furring and thereby isolating the enclosed portion of the furring.

Each insulation board advantageously comprises a flat rectangular panel having an insulating core. The insulating material of the core may be any of the well-known types possessing the desired thermal insulating properties, e.g., glass fibers, cellulosic or foam material, or combinations thereof. An especially useful material is a rigid, flexible or semi-rigid polymeric foam. Of especial interest are foam cores consisting of an isocyanate-based foam material, including polyurethane and polyisocyanurate foams. The panel may be variously constructed, such as as a prefabricated container filled with insulation or as a foam or other appropriate material to which one or more facing sheets are laminated during or after core production, as in U.S. Pat. No. 4,572,865.

In the overall wall system of the invention, the metal furrings are secured to the interior side of the outside wall elements which may be of any common construction, including concrete or masonry exterior walls. The metal furrings advantageously are vertically running Z-channels or strips, which are specially designed to accommodate the installation of rigid insulation board while providing an attachment for the wall elements to the interior side of the exterior wall. The Z-furring strips are spaced equidistantly from each other on the exterior wall and each insulating panel is positioned against this wall and between adjacent furring strips.

Each insulating panel is sufficiently thick so that its interior face projects further into the building space being insulated than the inner flanges of its two associated Z-furring strips, i.e., than the strips' flanges which are unattached to the exterior wall. The furrings strips are suitably arranged on the exterior wall so that these inner flanges extend in the same direction and the furring strips thereby readily accommodate the insulating panels which run parallel to the exterior wall and form a continuous covering of it. Each panel is constructed with the groove or kerf on its vertical side edge positioned to receive and engulf the inner flange of a furring strip while its other vertical side edge abuts the central web of the adjacent furring strip. In the embodiment wherein grooves are cut into both vertical side edges, the associated furring strips are positioned to have their inner flanges extending toward each other for engagement with the grooves. Interior surfacing, such as gypsum board, plaster or the like, is beneficially supported on the inner flanges of the furring strips to cover the inner surfaces of the insulating panels.

DESCRIPTION OF THE DRAWINGS

The invention will now be described with reference to the accompanying drawings in which.

DETAILED DESCRIPTION OF THE INVENTION

Figure 1:
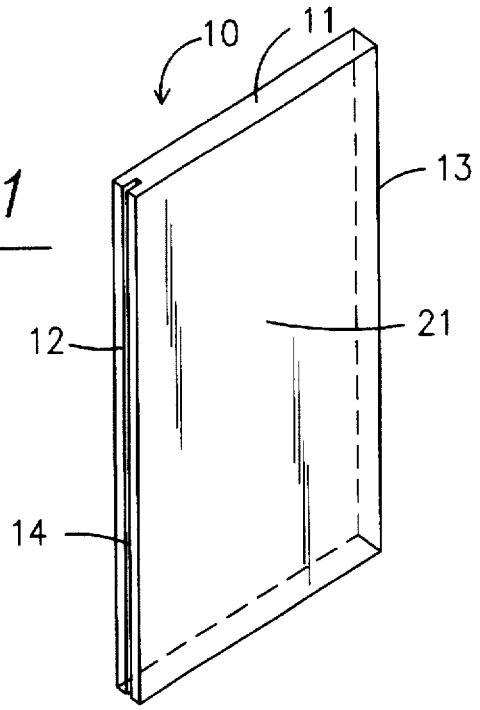
FIG. 1 is a perspective view of an insulating panel of the invention.

Referring now to the drawings, the present invention is directed to an improved prefabricated insulation panel which is uniquely, simply and economically constructed to lessen the heat transfer through metal furred walls. A plurality of the panels are joined together to form an insulating blanket comprising the wall system of the invention.

As shown in FIG. 1, a structural panel constructed in accordance with the invention, generally designated 10, comprises a layer or slab 11 of insulating material having two opposed major surfaces, each of which may be covered by a facing sheet or unfaced. Panel 10 has a first side edge 12, a second side edge 13, and unreferenced top and bottom edges. The first side edge 12 has a flat surface with an elongated, longitudinal slot 14 therein extending its full length and the second side 13 is uniformly flat.

The insulating material 11 may be any substance which retards or blocks heat transfer. In a preferred embodiment, insulation 11 is a core of foamed plastic material. Examples of these materials are polyurethane, polyisocyanurate, phenolic, rubber, polyvinyl chloride, urea-aldehyde, melamine-aldehyde, polystyrene, polypropylene, polyethylene, cellulosic acetate, epoxy, acrylonitrile-butadiene-styrene copolymer, silicone, and other polymeric foams.

The facers for covering foam core 11 may be composed of material which is flexible or rigid. A wide variety of materials are employable as the facers. Examples of the facers are a metal sheet such as steel or aluminum, plastic foils, a fiber glass sheet, an asphalt-saturated felt, an asphalt fiber glass sheet, paper, paperboard, plywood, perlite board, gypsum board, fiberboard, etc. The facers may be made from combinations of these materials.

A preferred rigid thermal insulation panel 10 of the invention is a product made with a closed-cell polyurethane or polyisocyanurate foam core faced on both major surfaces. The facers are suitably adhered to the faces of the foam core during the process of foam manufacture. A suitable foam plastic thermal insulation panel is one made by The Celotex Corporation of Tampa, Fla. under the designation Tuff-R®. Typical panel dimensions for use in the invention are 2 feet×8 feet and 2 feet×9 feet, although longer length panels may also be used.

Figure 2:
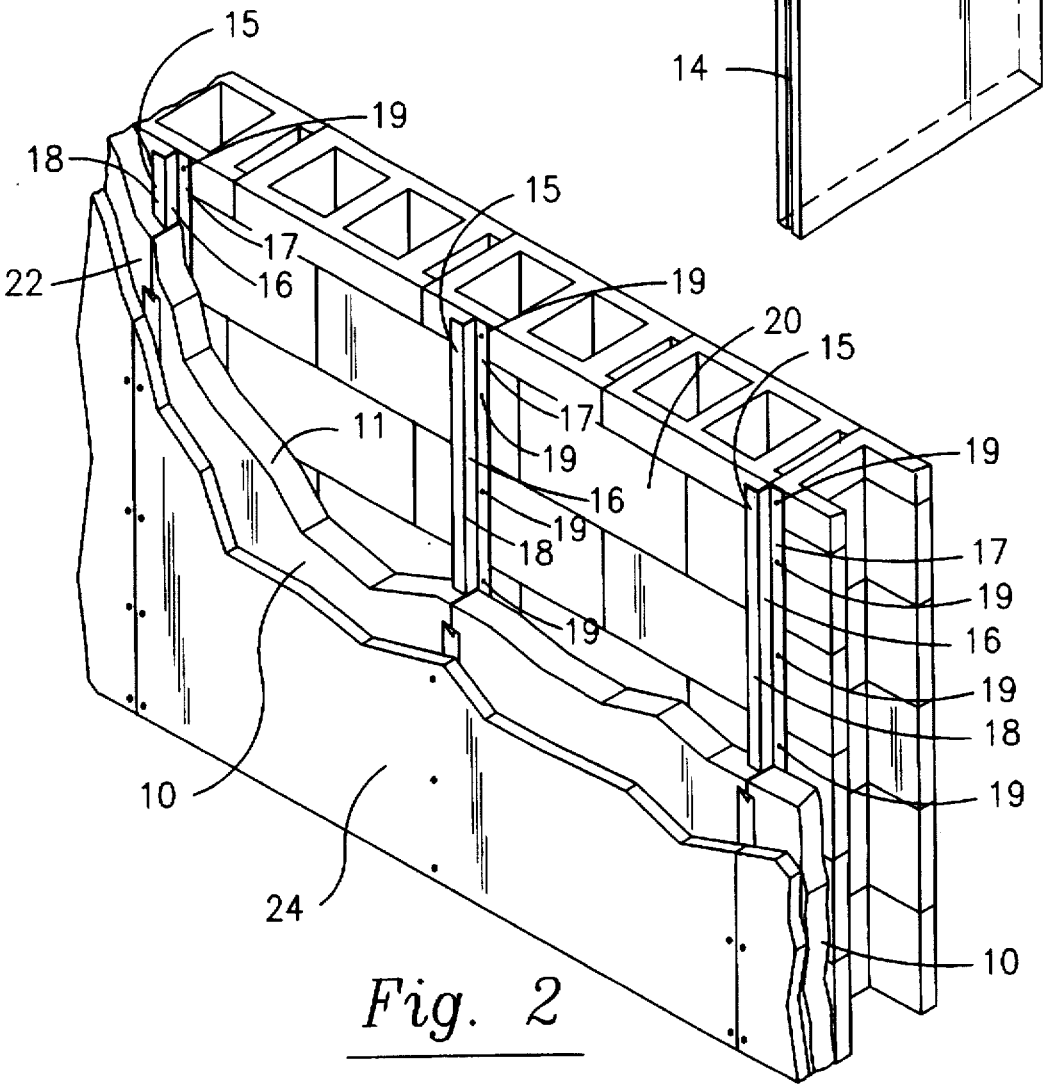
FIG. 2 is a perspective view of a fragmentary portion of a metal furred wall construction, with parts broken away and removed, embodying the insulation panel of FIG. 1.

Referring to FIG. 2, the improved wall construction of the invention is built about the metal furring strips 15 of the wall system. Each of the strips 15 is composed of a suitably rigid metal sheet such as mild or stainless steel or various other ferrous compositions well known in the building industry, such sheet material being shaped into a Z-configuration. Each strip includes a flat central web 16 which terminates at its ends in spaced, outwardly directed, parallel flanges 17 and 18 arranged in perpendicular order to the web and extending oppositely from each other. Through the use of masonry nails, Tapcon® screws or other equivalent fastening devices indicated at 19, the flanges 17 of the Z-furring strips are fixedly secured in direct engagement with the adjoining masonry wall 20. The Z-channels are applied vertically, 24" on center, with the fasteners 19 being long enough to penetrate approximately 1" into the masonry. Typically, the lengths of flanges 17 and 18 are ¾" and 1¼", respectively.

Figure 3:
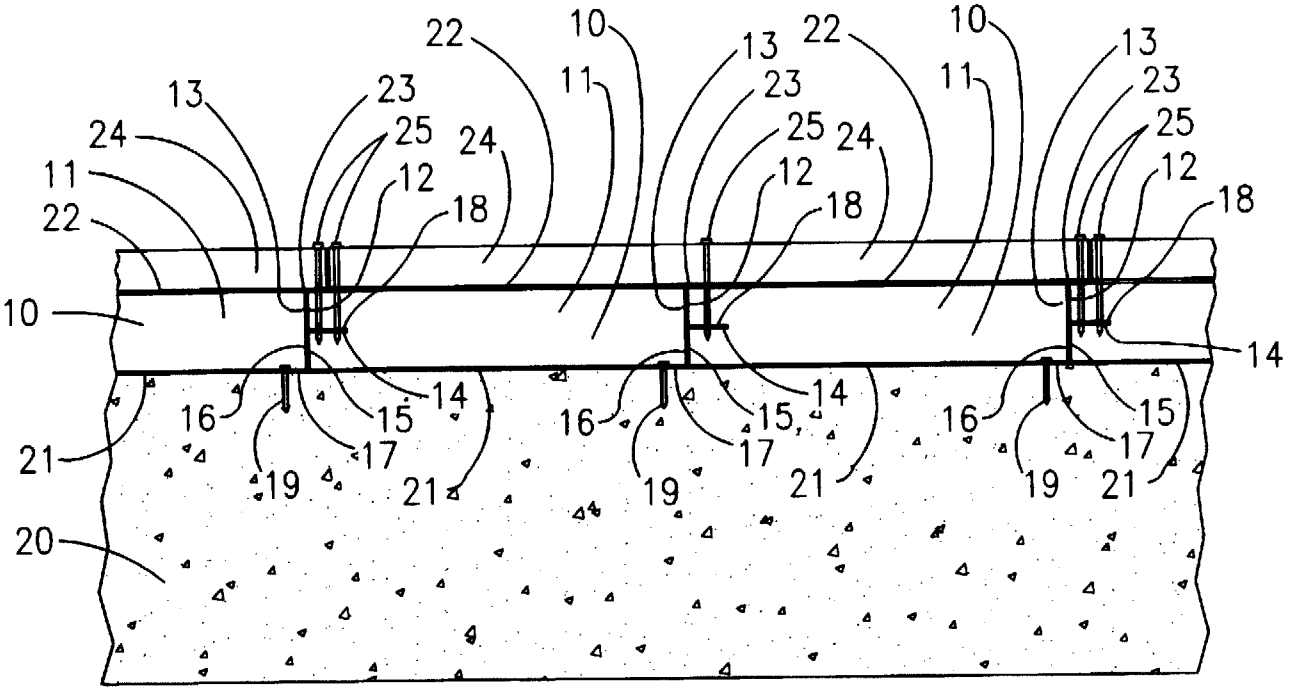
FIG. 3 is a fragmentary horizontal section showing a metal furred wall construction embodying the insulating panel of FIG. 1.

Referring now to FIGS. 2 and 3, rigid insulation panels 10 are placed against masonry wall 20 and between furring strips 15. The panels are 2 feet wide to fit between the strips but obviously the invention may be adapted for use in connection with other distances between centers. The core 11 of panels 10 preferably is a polyisocyanurate foam. Flexible facing sheets are adhered to both major faces of panels 10. Preferred flexible facing sheets for the front (facing wall 20) and back faces of panels 10 are aluminum foil facers 21 and 22, respectively.

Panels 10 generally may be of a thickness of from 1½ inches up to 2 inches or more depending on the desired R-value. In any event, the panels must be thick enough to extend inwardly from outer wall 20 beyond the inner flanges 18 of the Z-strips and to provide adequate insulating material 11 on both the inside and outside of these flanges for insulation thereof. For appropriate positioning of each insulation panel 10 adjacent wall 20, the panel's vertical slot 14 is spaced along side edge 12 for insertion and enclosure of flange 18 of the related furring strip. The other side edge 13 of the panel 10 will then have its flat surface adjoining the central web 16 of the adjacent furring strip.

The central web 16 of the Z-furring strips illustrated in FIGS. 2 and 3 may suitably range in length from 0.75 to 3.00 inches. A typical length for web 16 is 1 inch. Insulating panels 10 for use in conjunction with such 1 inch strips are consequently cut longitudinally along side edge 12 at 1 inch from the major face which will abut exterior wall 20. The remaining extension of the cut panels beyond kerf 14 into the building interior will depend on their total thickness. Insulating panels with thicknesses in the range from 1.5 to 2 inches will then project interiorly 0.5 to 1inch beyond kerf 14 and enclosed flange 18 of the furring strip.

The Z-furring strips 15 are formed with a flat central web 16 which is, for example, approximately 20 to 25 gauge in thickness. Thus, when adjoining panels 10 are placed to each side of such strip, the flat surface of side edge 12 of the one panel can be brought into contact with the flat surface of the opposed side edge 13 of the other panel due to this flatness of web 16. The result is that web 16 and flange 18 of the metal strip become tightly enclosed by the panels, whose insulating core material 11 significantly combats thermal short circuiting by the strip. Further protection of the wall assembly is suitably afforded by the application of a sealing tape 23 as a vapor barrier over the joints between adjoining panels 10.

The inside surface of the insulation panels 10 is covered by any suitable interior surfacing. As illustrated in FIGS. 2 and 3, sheets 24 of gypsum board are attached to flanges 18 of the furring strips by suitable fasteners 25, such as nails or screws. Although the fasteners 25 form thin conduits through the insulation panels 10 to the furring strips, they do not significantly diminish the insulating efficiency of the inventive system.

Figure 4:
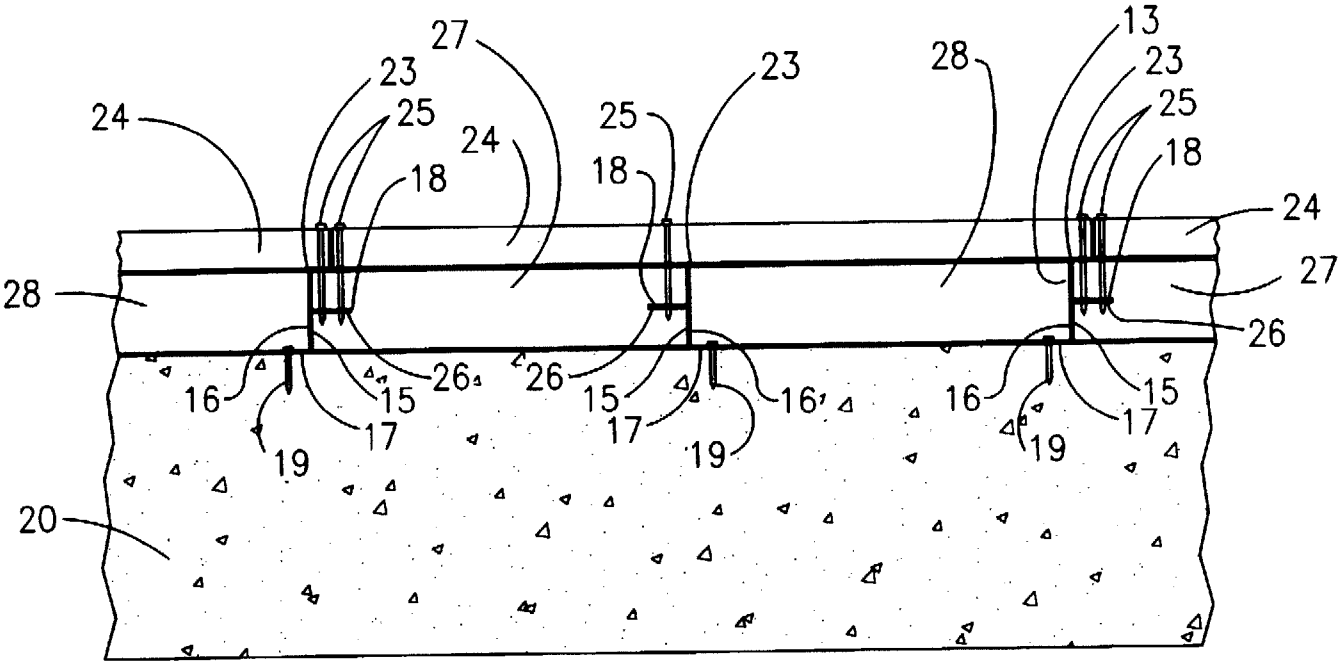
FIG. 4 is a fragmentary horizontal section showing a metal furred wall construction provided with another embodiment of insulating panels of the invention.

In accordance with the invention, vertical kerf 26 can be cut into both side edges of an insulating panel 27, as seen in FIG. 4. It is noted that in this embodiment, uncut panels 28 alternate with the cut panels 27 along the exterior wall in together forming a continuous insulating envelope.

Figure 5:
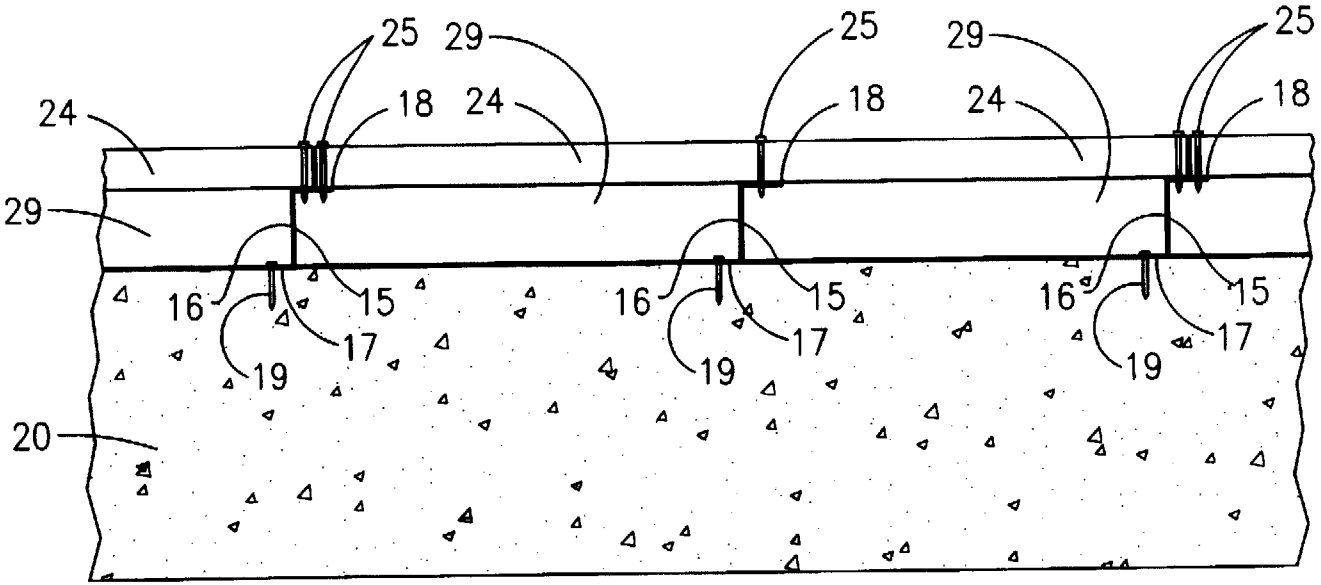
Fig. 5 PRIOR ART
FIG. 5 is a fragmentary horizontal section showing a conventional metal furred wall construction provided with insulating panels.

FIG. 5 shows a conventional wall assembly with metal Z-furring strips 15 installed on the inside surface of exterior wall 20. Insulating panels 29 are foam insulation panels arranged side by side along wall 20 and between furring strips 15 so that each vertically-extending side edge of the panels 29 faces and abuts against the central web 16 of the adjoining strip 15 over the length of the strip. The opposed surfaces of the panel's side edge and the strip's central web are basically coextensive. With this arrangement, the metal Z-furring forms a continuous metal path (thermal short) through the insulation from the exterior wall (e.g., concrete or masonry) to the interior wall (e.g., drywall product).

The kerfed insulating panels of the present invention eliminate such thermal short circuiting in Z-furring applications. Since the panels are kerfed for engagement with the Z-strips at a point between and interiorly of the panels' major faces, the wall system incorporating the panels provides a continuous envelope of insulation unbridged by the Z-strips. Also, the inventive system combats the telegraphing of conventional Z-furring systems which results in condensation and unsightly shadow streaks on the interior walls. The invention thus offers a quick and easy method to enhance the performance of metal furred wall systems, such as brick, block, precast and metal wall assemblies, by maintaining the systems' thermal integrity and capacity as a moisture barrier.

Those skilled in the art to which the invention relates will appreciate that other substitutions and modifications can be made to the described embodiments, without departing from the spirit and scope of the invention as described by the claims below.

I claim:

1. In a wall structure for a building which includes an exterior wall and a series of uniformly spaced and substantially similar metal furring strips attached to the interior side of and extending vertically from top to bottom of the exterior wall, each strip consisting of a central web and first and second flanges joined respectively to the opposed ends of the web, the central web extending inwardly from and generally perpendicularly to the exterior wall, and the first and second flanges extending generally perpendicularly to the central web and oppositely from each other, the first flange being attached to the exterior wall and the second flange being spaced from the exterior wall by the length of the central web and all the second flanges extending in the same direction, the improvement therein comprising: a plurality of insulating panels, each panel being adapted to fit and being interposed between each pair of two adjacent strips and against the exterior wall, each interposed panel having first and second major surfaces spaced from each other by the thickness of the interposed panel and first and second vertically-extending side edges, the first major surface facing the exterior wall and the second major surface being located inwardly from the exterior wall a distance equal to the thickness of the panel and greater than the length of the central web of each adjacent strip, the interposed panel being positioned so that the first side edge abuts the central web of the adjacent strip whose second flange projects toward the interposed panel, the first side edge having a groove extending from the top to the bottom of the panel and sized for enclosure of the second flange, and the groove being located at a distance from the exterior wall for engagement with and enclosure of the second flange, and the second side edge abuts the central web of the other adjacent strip, whereby the insulating panels form a continuous envelope around the strips to prevent thermal short circuiting.

2. The wall structure of claim 1 wherein the panels are comprised of insulating foam.

3. The wall structure of claim 1 wherein the panels are comprised of a closed-cell polyisocyanurate foam.

4. The wall structure of claim 1 wherein the second major surfaces of the panels are covered by gypsum boards.

5. The wall structure of claim 1 wherein a vapor barrier covers each vertical joint between abutting panels.

6. The wall structure of claim 1 wherein the central web of each strip is 1 inch in length and each panel is 1½ to 2 inches in thickness.

7. The wall structure of claim 1 wherein the panels are comprised of insulating foam and each major surface of the foam is covered by a facing sheet.

8. The wall structure of claim 1 wherein the panels are comprised of a closed-cell polyisocyanurate foam and each major surface of the foam is covered by a facing sheet.

9. In a wall structure for a building which includes an exterior wall and a series of uniformly spaced and substantially similar metal furring strips attached to the interior side of and extending vertically from top to bottom of the exterior wall, each strip consisting of a central web and first and second flanges joined respectively to the opposed ends of the web, the central web extending inwardly from and generally perpendicularly to the exterior wall, and the first and second flanges extending generally perpendicularly to the central web and oppositely from each other, the first flange being attached to the exterior wall and the second flange being spaced from the exterior wall by the length of the central web, the improvement therein comprising: a plurality of grooved and non-grooved insulating panels, the strips being positioned so that the second flange of each successive strip along the exterior wall extends oppositely to the second flange of the preceding strip, each grooved panel being positioned against the exterior wall and adapted to fit and being interposed between each pair of two adjacent strips positioned so that the second flanges extend toward each other, each interposed grooved panel having first and second major surfaces spaced from each other by the thickness of the interposed grooved panel and two vertically-extending side edges, the first major surface facing the exterior wall and the second major surface being located upwardly from the exterior wall a distance equal to the thickness of the interposed grooved panel and greater than the length of the central web of each adjacent strip, the interposed grooved panel being positioned so that each of the side edges abuts the central web of the respective adjacent strip, each side edge having a groove extending from the top to the bottom of the panel and sized for enclosure of the respective second flange, and the groove being located at a distance from the exterior wall for engagement with and enclosure of the respective second flange, and each non-grooved panel being positioned against the exterior wall and adapted to fit and being interposed between each pair of two adjacent strips positioned so that the second flanges extend away from each other, the interposed non-grooved panel having first and second major surfaces spaced from each other by the thickness of the interposed non-grooved panel and two vertically-extending side edges, the first major surface facing the exterior wall and the second major surface being located inwardly from the exterior wall a distance equal to the thickness of the panel and greater than the length of the central web of each adjacent strip, the interposed non-grooved panel being positioned so that each of the side edges abuts the central web of the respective adjacent strip, whereby the grooved and non-grooved insulating panels together form a continuous envelope around the strips to prevent thermal short circuiting.

* * * * *